US009168727B2

(12) United States Patent
Kylling et al.

(10) Patent No.: US 9,168,727 B2
(45) Date of Patent: Oct. 27, 2015

(54) INKING UNIT WITH ADJUSTMENT OF ROLLERS BY BENDING PLATE AND METHOD FOR ADJUSTMENT

(71) Applicant: Tresu A/S, Bjert (DK)

(72) Inventors: Mads Kylling, Haderslev (DK); Marko Ryynänen, Pulp (FI)

(73) Assignee: TRESU A/S, Bjert (DK)

( * ) Notice: Subject to any disclaimer, the term of this patent is extended or adjusted under 35 U.S.C. 154(b) by 0 days.

(21) Appl. No.: 14/396,945

(22) PCT Filed: Apr. 22, 2013

(86) PCT No.: PCT/DK2013/050118

§ 371 (c)(1),
(2) Date: Oct. 24, 2014

(87) PCT Pub. No.: WO2013/159780

PCT Pub. Date: Oct. 13, 2013

(65) Prior Publication Data

US 2015/0096453 A1 Apr. 9, 2015

(30) Foreign Application Priority Data

Apr. 24, 2012 (DK) ..... 2012 70209

(51) Int. Cl.

| | |
|---|---|
| ***B41F 7/02*** | (2006.01) |
| ***B41F 5/24*** | (2006.01) |
| ***B41F 31/30*** | (2006.01) |
| ***B41F 13/24*** | (2006.01) |

(52) U.S. Cl.
CPC . *B41F 5/24* (2013.01); *B41F 13/24* (2013.01); *B41F 31/30* (2013.01)

(58) Field of Classification Search
CPC ..... B41F 13/24
USPC ..... 101/218
See application file for complete search history.

(56) References Cited

U.S. PATENT DOCUMENTS

| | | | | |
|---|---|---|---|---|
| 3,732,813 | A * | 5/1973 | Vir Singh et al. | 101/216 |
| 5,027,704 | A * | 7/1991 | Holl et al. | 101/148 |
| 5,385,093 | A | 1/1995 | Rogge et al. | |
| 5,471,929 | A * | 12/1995 | Rogge et al. | 101/247 |
| 5,868,071 | A | 2/1999 | Niemiro et al. | |
| 6,109,180 | A | 8/2000 | Guaraldi et al. | |
| 6,691,612 | B1 * | 2/2004 | Herrmann et al. | 101/352.01 |
| 7,651,454 | B2 | 1/2010 | Reymond et al. | |
| 8,875,630 | B2 * | 11/2014 | Izume et al. | 101/480 |
| 2001/0006026 | A1 * | 7/2001 | Gottling et al. | 101/216 |
| 2005/0252401 | A1 * | 11/2005 | Weschenfelder et al. | 101/415.1 |
| 2010/0263559 | A1 * | 10/2010 | Novak et al. | 101/216 |

FOREIGN PATENT DOCUMENTS

| | | |
|---|---|---|
| EP | 0 899 097 A1 | 3/1999 |
| EP | 0 942 192 A1 | 9/1999 |
| GB | 2 142 577 A | 1/1985 |

* cited by examiner

*Primary Examiner* — Anthony Nguyen
(74) *Attorney, Agent, or Firm* — Roberts Mlotkowsi Safran & Cole, P.C.

(57) ABSTRACT

A printing unit (1) has a first roller (2) and a second roller (3) provided substantially parallel and facing each other for transporting of printing sheets between the first roller (2) and the second roller (3). The first roller (2) is rotationally mounted at only one end (10) of the first roller (2) and this end (10) is mounted to a deflector (9). The deflector (9) has a connection (11) to a support (12) for resiliently changing the angle of the first roller (2) relatively to the second roller (3) by bending the connection (11).

11 Claims, 3 Drawing Sheets

INKING UNIT WITH ADJUSTMENT OF ROLLERS BY BENDING PLATE AND METHOD FOR ADJUSTMENT

BACKGROUND OF THE INVENTION

1. Field of the Invention

The present invention relates to a printing unit comprising a first roller and a second roller provided substantially parallel and facing each other for transport of printing sheets between the rollers. The rollers have substantially parallel rotation axes for transport of printing sheets between the first roller and the second roller by abutting the printing sheets from either side or for transfer of liquid from one to the other of the first roller and the second roller by abutment of the first roller to the second roller. The first roller is rotationally mounted to a deflector at only one end of the first roller. The deflector comprises a connection to a support, by which the parallel orientation can be adjusted as well as the contact pressure between the rollers. The invention also comprises a method for adjusting the angle between two rollers in a printing unit.

2. Description of Related Art

In flexographic printing presses, mounting of printing rollers at only one end is attractive when used with sleeves, because the exchange of such sleeve is easier than in presses where the rollers are mounted at both ends. However, the mounting of the rollers at only one end implies a challenge with respect to suitable adjustment mechanisms by which a parallel contact and equalized pressure between the rollers is assured in order to provide uniform transfer of ink between the rollers.

U.S. Pat. No. 5,385,093 by Rogge assigned to Windmoeller and Hoelscher discloses an inking unit with a cantilevered inking roller and plate cylinder, which both are mounted only at one end. In order to achieve parallel adjustment between the inking roller and the plate cylinder and in order to achieve uniform contact pressure between the rollers, the inking unit has a cantilevered mount of the plate cylinder. This mount comprises an arrangement, wherein a screw pushes on one side of a lever, the rotation of which moves a pin in a groove. The groove allows a free motion of the pin in one dimension, but not in the lateral direction; instead, the lateral direction of the pin causes the pin to push onto the plate cylinder block, causing a rotation of the plate cylinder block around a further rotation pin. The rotation of the plate cylinder block causes rotation of the plate cylinder axle and thereby adjusts the angle between the plate cylinder and the inking roller.

This system is rather complicated due to its many rotational parts. For example, the screw is engaged in a bearing on the lever, the bearing is rotating in the lever about a first rotational axis, the lever is rotating about a second rotating axis, and the plate cylinder block is rotating about a third rotating axis. Likewise, three rotational axes are used for the inking roller block when it has to be adjusted together with the plate cylinder against an impression cylinder. The many rotational parts and the relatively complicated interplay between the rotational parts, pins, and grooves make the system difficult, heavy and expensive in fabrication.

Other systems for adjusting printing rollers that are mounted in only one end are disclosed in U.S. Pat. No. 6,109,180 by Guaraldi et al. and in U.S. Pat. No. 5,471,929 by Rogge. An offset printing machine with rollers that can be adjusted is disclosed in UK Patent Application GB 2 142 577 A by Atkinson. An elastic element for mounting printing units is disclosed in European Patent Application EP 0 942 192 A1.

SUMMARY OF THE INVENTION

Therefore, it is an object of the present invention to provide an improvement in the art. Especially, it is an object of the invention to provide a simplified system for angular adjustment of rollers that are mounted at only one end in a printing unit. This object is achieved with a printing unit according to the following.

The printing unit comprises a first roller and a second roller provided parallel or substantially parallel and facing with each other. Such rollers in printing units are used for transport of printing sheets between the first roller and the second roller by abutting the printing sheets from either side or the rollers may be used for transfer of liquid from one to the other of the first roller and the second roller by abutment of the first roller to the second roller.

The first roller has a first rotation axis, and the second roller has a second rotation axis, the axes being aligned parallel or substantially parallel, and for which the invention seeks to provide adjustment means overcoming the drawbacks of the prior art.

The first roller is rotationally mounted at only one end of the first roller, and this one end is mounted to a deflector. The deflector comprises a connection to a support; the connection being resilient for resiliently changing the angle of the first roller relatively to the second roller by slightly bending the connection. Thus, the connection of the deflector can then be resiliently bent, which changes the angle of the first roller relatively to the second roller, by which the parallel orientation can be adjusted as well as the contact pressure between the rollers.

The system according to the invention is a simple and light-weight technical solution, which can be produced at low costs.

The first and the second rotation axes approximately define a plane; the term "approximately" is used because a deviation from precise parallelism between the first roller and the second roller is less than 3 degrees or less than 2 degrees and typically even less than 1 degree. The deviation can be reduced by the means for adjustment as herein described. In case that the first and the second roller are used for transport of printing sheets in between them, the plane may be defined as perpendicular to a direction of transport of the sheets between the rollers.

For example, the connection is resilient about a bending axis perpendicular to such plane for resiliently changing the angle of the first roller relatively to the second roller by bending the connection about the bending axis. Typically, such a bending axis exists, although a bending along a non-circular path is possible, for example, along a parabola; in approximation however, due to the small angle, the bending would approximately be circular and imply a corresponding bending axis.

In order to prevent uncontrolled bending of the deflector in various directions, the connection advantageously is rigid in directions normal to the first rotation axis. In other words, the connection is rigid for bending in directions about the rotation axis, whereas bending about an axis perpendicular to the rotation axis, for example, about a bending axis perpendicular to the above defined plane, is used for adjustment.

For example, the rigidity of the connection—and the deflector in general—for bending about the first rotation axis, or even for bending about directions normal to the above defined bending axis perpendicular to the plane, is more than 100 times or 1000 times higher than the rigidity of the connection for bending about the bending axis perpendicular to the above defined plane.

For example, the deflector comprises a plate with a first part attached to the first roller and a second part mounted to the support. Such a plate may have a plate length and a plate width and have a first plane surface and a second plane surface and a thickness in between the two plane surfaces. If the thickness of the plate is much less than its length and width, for example, at least 5 times less or at least 10 times less, it will tend only to bend about an axis parallel to the plane surfaces.

In some embodiments, the printing unit further comprises a base with a base surface facing the surface of the deflector at a distance for providing an interspace between the deflector surface and the base surface. By changing the distance between the deflector surface and the base surface, the connection is bent, which also adjusts the angular orientation of the first roller.

Optionally, the deflector is resiliently biased relatively to the base surface, and the means for changing the distance are configured to change the distance under biased conditions.

The distance can be changed in various ways. For example, a screw may be used for resiliently deflecting the deflector. In an embodiment, the screw has an outer threading in engagement with an inner threading in the base. When the screw is turned, it moves longitudinally through the base and its end can be used to abut the deflector surface and press the deflector away from the base. When the screw is turned the opposite way, the tension on the deflector is released again, and the deflector flexes back to a position where it is not forced by the screw. By keeping the screw abutting the deflector under flexible tension, adjustment of the screw flexes the deflector away and towards the base, which is a convenient way for adjusting the first roller relatively to the second roller.

Alternatively, the deflector is moved by a wedge arrangement with at least one wedge, for example, with a single wedge or a double wedge. The wedge arrangement has two opposite sides, one of the two sides abutting the deflector surface and the opposite side abutting the base surface for changing the distance by moving the at least one wedge inside the interspace. In a simple embodiment, a single slidable wedge is provided at least partly in the interspace; the wedge has two sides tapering towards each other and the two sides abut the base surface and the deflector surface, respectively. By driving the wedge into the interspace, the distance between the deflector and the base is increased, whereas it is decreased, when the wedge is pulled out of the interspace. For the movement, there are provided means for moving the wedge in the direction in and out of the interspace and thereby adjusting the distance between the deflector surface and the base surface. Alternatively, the wedge arrangement comprises two wedges that have their tapering surfaces facing each other, and the opposite surface of one of the wedges abuts the deflector surface and the opposite surface of the second wedge abuts the base surface. In this case, the distance is varied by sliding the two wedges relatively to each other. Such a wedge arrangement works smoother in the interspace than inserting a single wedge, because the two outer surfaces that abut the base surface and the deflector surface, respectively, are parallel.

In further embodiments, the deflector comprises a plate with a first part attached to the first roller and a second part mounted to the support, and the connection connects the first part with the second part. Optionally, the connection has a thinned part adjacent to the second part, where the thinned part has a material thickness that is thinner than the material thickness of the first part of the plate. The connection will primarily tend to bend in the thinned part, such that the thinned part assists in defining a bending axis near the thinned part for the bending of the connection.

Although the device is called a printing unit, the transfer of liquid from the roller to the print need not necessarily be ink, it may as well be a transparent lacquer, the transfer of which is also a way of using the printing unit. For example, printed sheets may be provided by offset printing or by digital printing upstream of the printing unit. Digital printing, including laser printing and inkjet printing, is attractive in cases where only a small number of sheets are printed, or where large numbers are printed but with slightly varying prints. The printed sheets are then transported to the printing unit with the first and second rollers. When passing between the rollers, the first roller may transfer further ink or just transparent lacquer on top of the printed sheet. The lacquer may be collected from a doctor blade chamber and applied to the first roller in a well defined layer, which then is transferred to the printed sheets. In case that the printing unit is used in cooperation with a digital printer, the rollers will typically be relatively small, for example, having a length of less than one meter, for example, between 40 and 80 centimeters.

Apart from the first and the second roller, the printing unit may comprise further rollers. It should also be pointed out that the second roller may also have an angular adjustment system similar to the system as described above for the first roller.

The invention will be explained in more detail with reference to the accompanying drawings.

DETAILED DESCRIPTION OF THE INVENTION

Figure 1A:
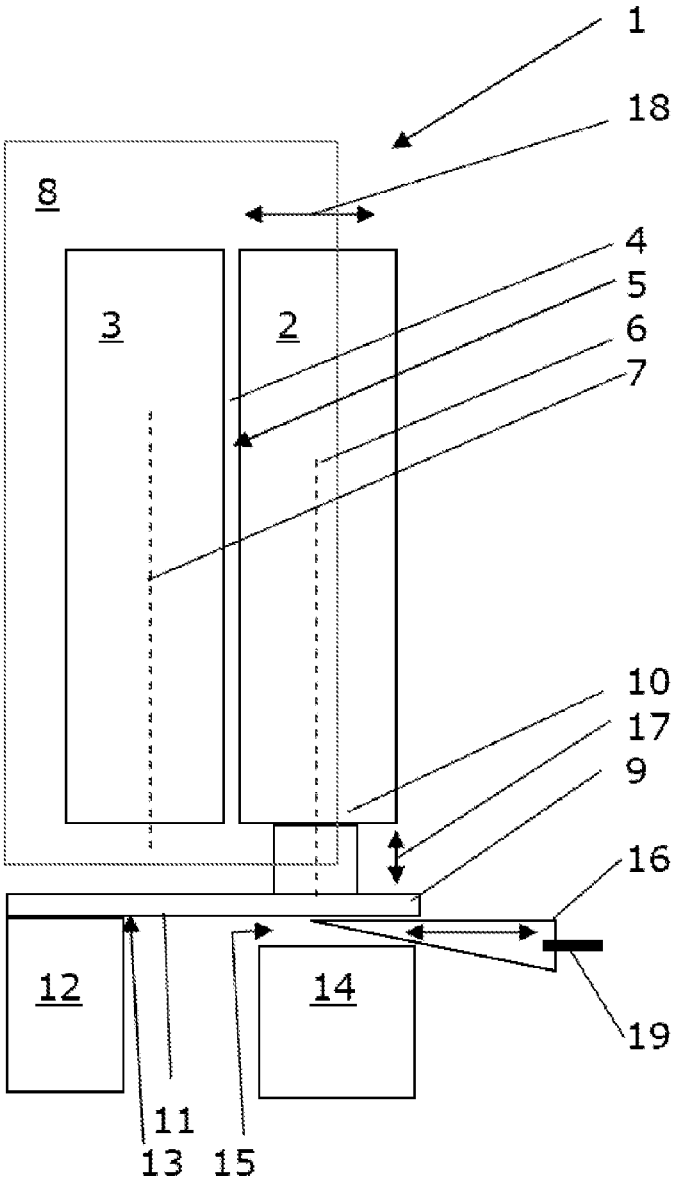
FIGS. 1*a* & 1*b* are schematic views a printing unit and an alternative wedge arrangement for the printing unit, respectively.

FIG. 1*a* illustrates a basic principle of the invention. A printing unit 1 comprises a first roller 2 and a second roller 3 in substantially parallel contact with each other along a contact zone 4 for transporting of printing sheets through the contact zone 4 between the rollers 2, 3. Although, the contact zone 4 typically would imply a contact between the first roller 2 and the second roller 3, this is not important for the invention, as the contact zone 4 alternatively may imply a small interspace 5 between the rollers 2, 3 in case that the print sheets are relatively thick, such that an interspace 5 is needed. However, such print sheets would be in contact with both rollers 2, 3 when rolling through the interspace 5.

The first roller 2 has a first rotation axis 6 and the second roller 3 has a second rotation axis 7, the first rotation axis 6 and the second rotation axis 7 approximately define a plane 8 perpendicular to a direction of the transport of the sheets between the rollers 2, 3. The first roller 2 is rotationally mounted at only one end 10 of the first roller 2. The first roller is mounted to a deflector 9 that comprises a connection 11 to a support 12. The connection 11 is resilient about a bending axis 13 which is perpendicular to the plane 8; thus, the bending axis is also perpendicular to the plane of the figure.

A base 14 is provided with a base surface facing a deflector surface of the deflector 9 between which there is provided an interspace 15. A wedge 16 can be moved in directions in and out of the interspace 15, by which the width of the interspace is changed and which results in a deflection of the deflector in the perpendicular direction, as indicated with a double arrow 17. This deflection causes a rotation of the deflector about the bending axis 13. As a result, the angle of the first roller 2 relatively to the second roller 3 is changed. As the angular adjustment is minimal, the deflection can appropriately be illustrated by a movement of the unsupported end of the first roller 2 according to the double arrow 18. Due to this deflection, the contact pressure between the first roller 2 and the second roller 3 can be adjusted to become uniform for proper transfer of liquid from one roller to the other, or, alternatively, the distance between the first roller 2 and the second roller 3 can be adjusted to be uniform along the length of the rollers in order to assure a proper transport of paper through the interspace 5.

The movement of the wedge 16 can be accomplished by various means, for example, a screw 19 arrangement or an actuator. Using a wedge 16 implies a very precise adjustment by simple means. The wedge 16 can be shaped with a very small inclination such that a relatively large linear movement of the wedge 16 is necessary for small angular changes of the first roller 2.

It is noted for sake of good order that the adjustment can also be achieved by employing various wedges at various locations in the interspace. By using various wedges, bending not only around the illustrated bending axis so as to obtain a two dimensional bending.

Figure 1B:
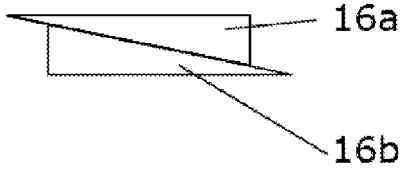

FIG. 1*b* illustrates a wedge arrangement as an alternative to the wedge of FIG. 1*a*. The two wedges 16*a*, 16*b* have their tapering surfaces facing each other. In this case, the distance is varied by sliding the two wedges 16*a*, 16*b* relatively to each other. Such a wedge arrangement works smoother in the interspace than inserting a single wedge.

Figure 2A:
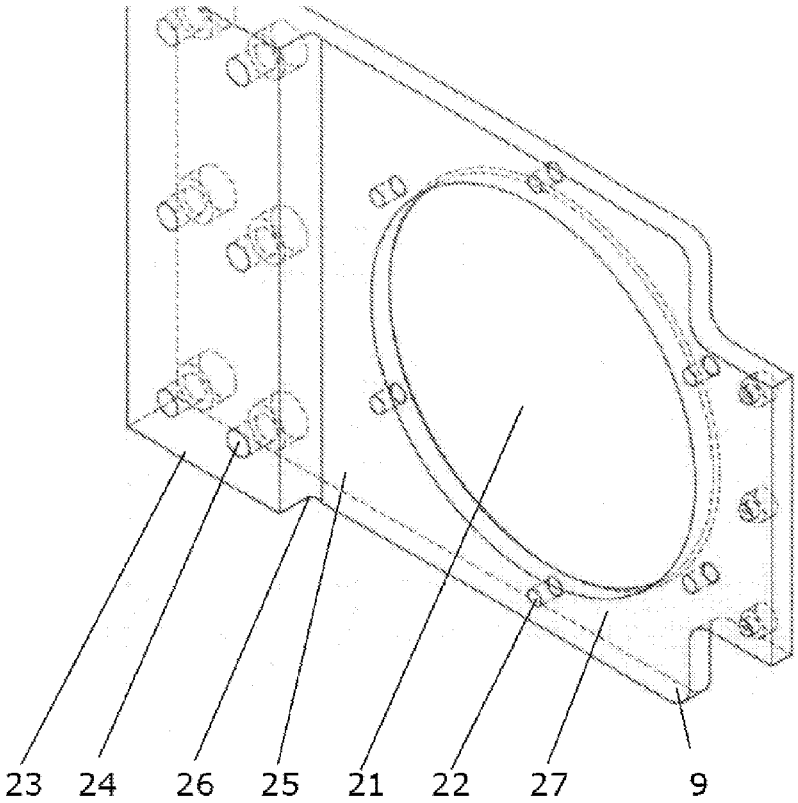
FIGS. 2*a* & 2*b* are a perspective view and a side view, respectively, of a deflector.
Figure 2B:
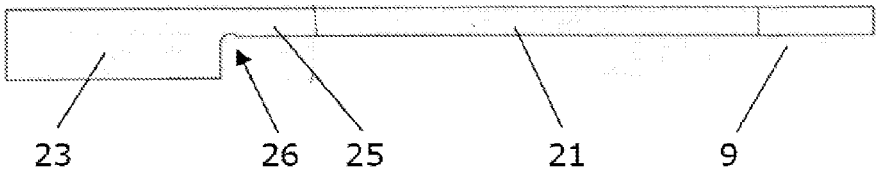

FIGS. 2*a* & 2*b* illustrate an example of a deflector 9. The deflector 9 is shaped as a plate with first part 27 having a mounting hole 21 into which the end 10 of the first roller 2 fits and is fastened with screws (not shown) extending through screw holes 22. One end of the deflector 9 comprises a second part 23, which is a thickened end part with mounting holes 24 for mounting of the deflector 9 to the support 12. Between the mounting hole 21 and the thickened end part 23, there is provided a connection 25, which has a thinned part 26 in order to provide a controlled bending about a relatively well defined bending axis, which is near the thinned part. The thinned part 26 of the connection 25 can be clearly seen in FIG. 2*b*.

The deflector plate and the mechanism for moving the wedge into the interspace between the deflector and a base has a groove in which the wedge is movable. An actuator can be provided at one end of the wedge for moving the wedge along the groove. The deeper the wedge 16 is pressed into the interspace 15 between the base 14 and the deflector 9, the more the deflector 9 is pressed in the direction away from the base 14. This deflection of the deflector 9 results in a bending/tilting of the first roller 2 towards or away from the second roller 3.

As mentioned before, the wedges could be substituted by screw arrangements or other arrangements that are suitable to vary the distance in the interspace 15 in a controlled way.

Figure 3:
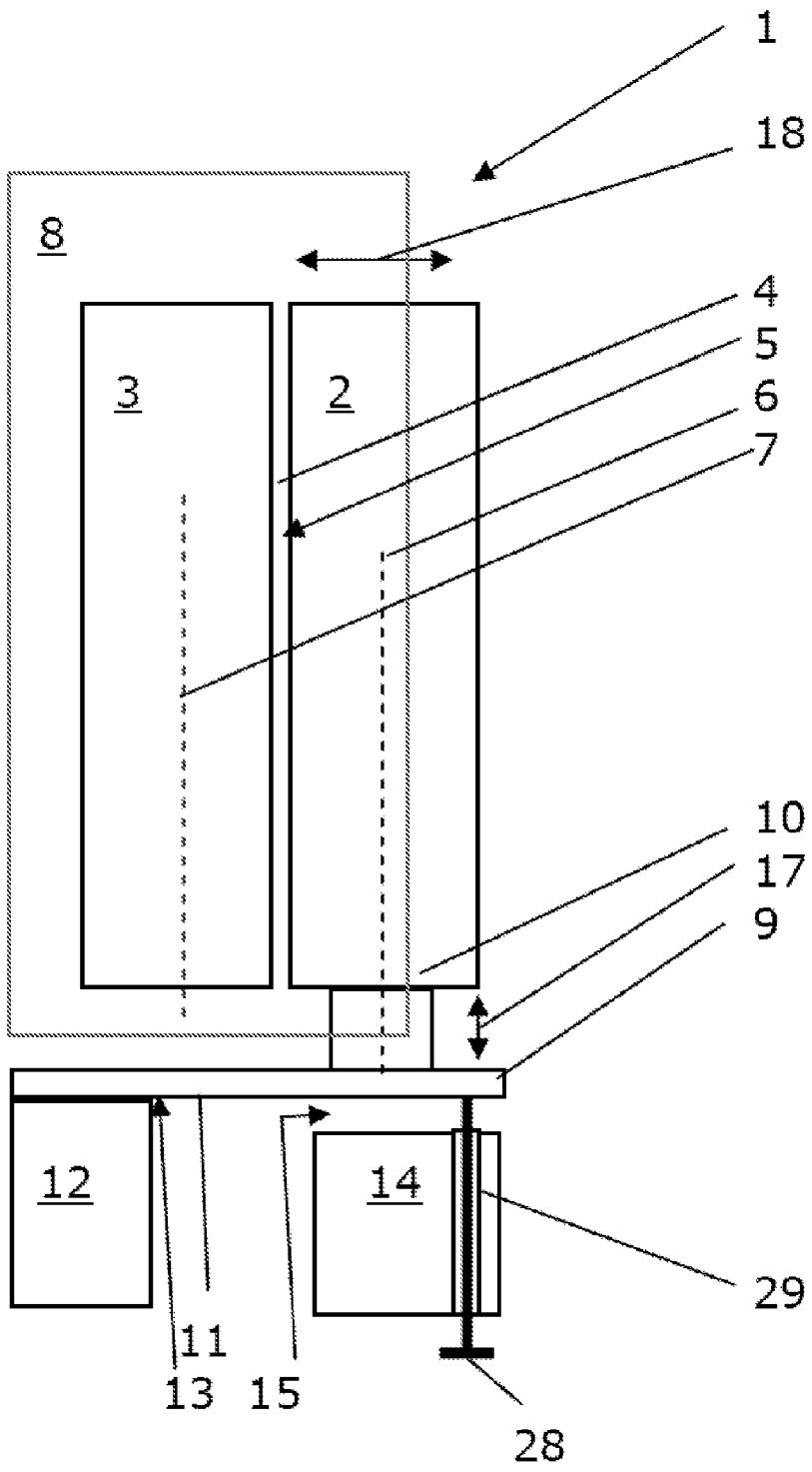
FIG. 3 is a schematic view of a printing unit with an alternative deflection mechanism.

FIG. 3 illustrates an alternative arrangement, where a screw 27 is used as an alternative to a wedge for bending deflecting the deflector 9. The screw 27 has an outer threading in engagement with an inner threading 28 in the base 14. When the screw is turned while in attachment to the deflector 9, it moves the deflector 9 by causing a bending of the connection 11 in analogy with the wedge arrangement of FIG, 1.

What is claimed is:

1. A printing unit comprising a first roller and a second roller provided substantially parallel and facing each other for transport of printing sheets between the first roller and the second roller by abutting the printing sheets from either side or for transfer of liquid from one to the other of the first roller and the second roller by abutment of the first roller to the second roller; wherein the first roller has a first rotation axis and the second roller has a second rotation axis; wherein the first roller is rotationally mounted at only one end of the first roller and wherein this one end is mounted to a deflector; the deflector comprising a connection to a support; the connection being resilient for resiliently changing the angle of the first roller relatively to the second roller by bending the connection.

2. A printing unit according to claim 1, the first and the second rotation axes approximately define a plane and the connection is resilient about a bending axis perpendicular to the plane for resiliently changing the angle of the first roller relatively to the second roller by bending the connection about the bending axis.

3. A printing unit according to claim 2, wherein the connection is rigid against bending in a direction normal to the bending axis, wherein the rigidity of the connection in directions normal to the bending axis is more than 100 times higher than the rigidity of the connection for bending about the bending axis.

4. A printing unit according to claim 1, wherein the deflector has a deflector surface and wherein the printing unit further comprises a base with a base surface facing the deflector surface at a distance for providing an interspace between the deflector surface and the base surface, wherein means are provided for changing the distance for thereby bending the connection.

5. A printing unit according to claim 3, wherein the deflector is resiliently biased relatively to the base surface, and the means for changing the distance are configured to change the distance under biased conditions.

6. A printing unit according to claim 4, wherein the means for changing the distance comprise a wedge arrangement with at least one slidable wedge in the interspace, the wedge arrangement having two opposite sides, one of the two sides abutting the deflector surface and the opposite side abutting the base surface for changing the distance by moving the at least one wedge inside the interspace.

7. A printing unit according to claim 1, wherein the deflector comprises a plate having a plate length and a plate width and having a first plane surface and a second plane surface and a thickness in between the two plane surfaces, wherein the thickness of the plate is at least 5 times less than at least one of its length and width in order to promote bending about an axis parallel to the plane surfaces.

8. A printing unit according to claim 1, wherein the deflector comprises a plate with a first part attached to the first roller and a second part mounted to the support, wherein the connection connects the first part with the second part and comprises a thinned part adjacent to the second part, the thinned part having a material thickness that is thinner than the material thickness of the first part of the plate in order for the thinned part to assist in defining a bending axis near the thinned part for the bending of the connection.

9. A method for adjusting the angle between two rollers in a printing unit, the printing unit comprising a first roller and a second roller arranged substantially parallel and facing with each other for transport of printing sheets between the first roller and the second roller by abutting the printing sheets from either side or for transfer of liquid from one to the other of the first roller and the second roller by abutment of the first roller to the second roller; wherein the first roller has a first rotation axis and the second roller has a second rotation axis; wherein the first roller is rotationally mounted to a deflector at only one end of the first roller; the deflector comprising a connection to a support; the connection being resilient about a bending axis perpendicular to the plane for resiliently changing the angle of the first roller relatively to the second roller by bending the connection; wherein the method comprises resiliently bending the connection and thereby changing the angle of the first roller relatively to the second roller.

10. A method according to claim 9, wherein the deflector has a deflector surface and wherein the printing unit further comprises a base with a base surface facing the deflector surface at a distance, thereby providing an interspace between the deflector surface and the base surface, wherein the method comprises changing the distance between the deflector surface and the base surface and thereby bending of the connection.

11. A method according to claim 10, wherein the method comprises resiliently biasing the deflector relatively to the base surface and changing the distance are configured to change the distance under resiliently biased conditions.

* * * * *